United States Patent [19]

Garcia

[11] 4,193,286

[45] Mar. 18, 1980

[54] VEHICLE CONTROL ARM SPREADER TOOL

[75] Inventor: Moises R. Garcia, Dona Ana, N. Mex.

[73] Assignee: The United States of America as represented by the Secretary of the Army, Washington, D.C.

[21] Appl. No.: 906,904

[22] Filed: May 18, 1978

[51] Int. Cl.[2] ..... B21D 1/12

[52] U.S. Cl. ..... 72/462; 72/476; 72/704

[58] Field of Search ..... 72/704, 705, 381, 392, 72/476, 411, 380, 386, 388, 462, 470

[56] References Cited

U.S. PATENT DOCUMENTS

| | | | |
|---|---|---|---|
| 1,095,299 | 5/1914 | Tils | 72/381 |
| 1,524,753 | 2/1925 | Schwerin | 72/705 X |
| 2,135,278 | 11/1938 | Countryman | 72/392 |
| 3,460,226 | 8/1969 | Hildebrand | 72/476 |
| 3,730,478 | 5/1973 | Burke | 72/470 |
| 3,760,628 | 9/1973 | Castoe | 72/705 X |

FOREIGN PATENT DOCUMENTS

| | | | |
|---|---|---|---|
| 627436 | 9/1961 | Canada | 72/705 |
| 58540 | 11/1946 | Netherlands | 72/392 |
| 1390393 | 4/1975 | United Kingdom | 72/705 |

*Primary Examiner*—Francis S. Husar
*Assistant Examiner*—D. M. Gurley
*Attorney, Agent, or Firm*—Nathan Edelberg; Robert P. Gibson; Peter A. Taucher

[57] ABSTRACT

A tool for straightening a bent control arm in an automotive vehicle suspension system: said tool comprising a first presser element slidably positionable on the control arm shaft, a second presser element affixable to an end of the control arm pivot shaft, and screw-nut means for drawing the first presser element toward the second presser element to thereby effect a straightening action on the bent area of the control arm. A power wrench is the preferred instrumentality for advancing the nut along the screw.

3 Claims, 8 Drawing Figures

VEHICLE CONTROL ARM SPREADER TOOL

BACKGROUND AND SUMMARY OF THE INVENTION

In certain automotive vehicles coil springs are used as vehicle suspension devices. Commonly each coil spring is trained between a lower control arm and an upper control arm, both arms being swingably carried on pivot shafts carried by the frame and cross member of the vehicle. If the vehicle is subjected to harsh service the road forces on the suspension may tend to bend or twist the lower control arm, particularly at the control arm areas in near adjacency to the pivot shaft. A bent control arm can contribute to front wheel misalignment. Under conventional practice a wheel alignment operation often entails not only the usual wheel caster-camber and toe-inadjustments but also replacement of the bent control arm.

The present invention is directed to a tool which can be applied to a bent lower control arm for returning the bent area of the control arm to substantially its original unbent condition. The tool is designed for manufacture from standard stock or hardware, using conventional machine shop and welding procedures; the tool is a relatively low cost mechanism.

The invention described herein may be manufactured, used, and licensed by or for the Government for governmental purposes without payment to me of any royalty thereon.

THE DRAWINGS

FIG. 1 schematically illustrates a vehicle suspension having a lower control arm that can be repaired with the tool of the present invention.

Figure 1:
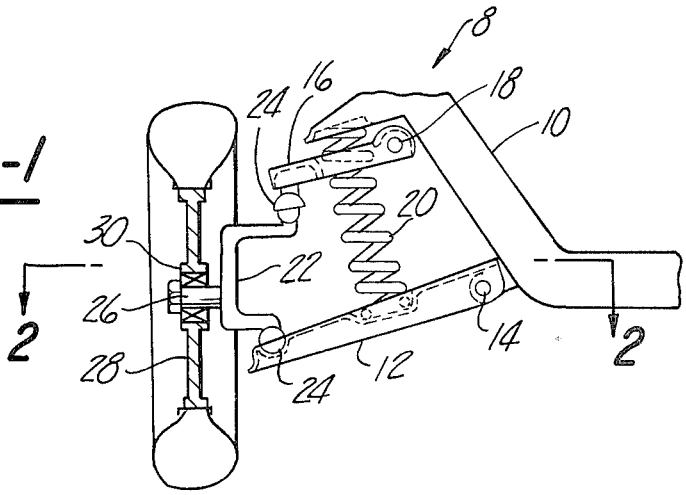
Figure 2:
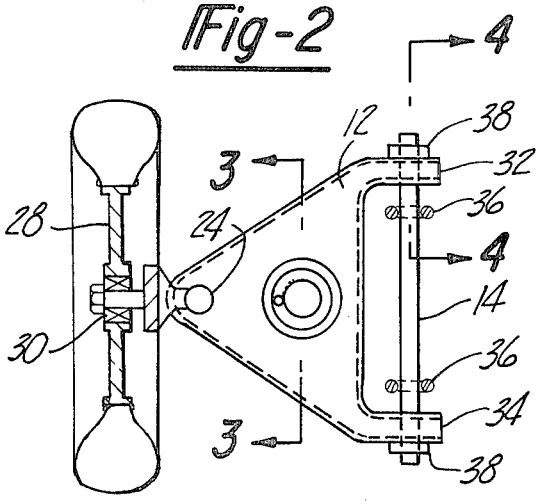
FIG. 2 is a sectional view taken generally on line 2—2 in FIG. 1.

Referring particularly to FIGS. 1 and 2, there are shown some features of a conventional automotive vehicle suspension designated by numeral 8. The suspension comprises a vehicle frame cross member 10, a lower suspension control arm 12 swingably mounted on a pivot shaft 14 carried by frame member 10, an upper control arm 16 swingably mounted on a pivot shaft 18 carried by frame component 10, and a coil spring 20 trained between the lower control arm 12 and frame member 10 for exerting a resilient vehicle suspension action. Each control arm is operatively connected to the wheel knuckle 22 through a ball joint 24. Knuckle 22 carries a spindle 26 that rotatably connects with wheel disc 28 through anti-friction bearings 30 in conventional fashion. In many instances a shock absorber (not shown) would be located within spring 20 to exert the desired dampening effect on the spring system.

Figure 3:
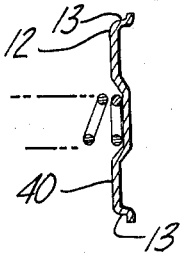
FIG. 3 is a sectional view taken generally on line 3—3 in FIG. 2.

As best seen in FIG. 2, lower control arm 12 includes two widely spaced end sections 32 and 34, said sections having bushings therein rotatably encircling the projecting ends of pivot shaft 14. Shaft 14 is clamped to the undersurface of frame component 10 by means of two U-bolts 36. Suspension arm 12 is prevented from displacement off of shaft 14 by nuts 38 threaded onto the ends of the shaft. As best seen in FIG. 3, control arm 12 is a metal stamping 40 having a peripheral flange 13. In FIG. 2 flange 13 is designated by dotted lines paralleling the outer contour of the metal stamping. The flanged end sections 32 and 34 have U cross sections, as shown best in FIG. 4.

Figure 4:
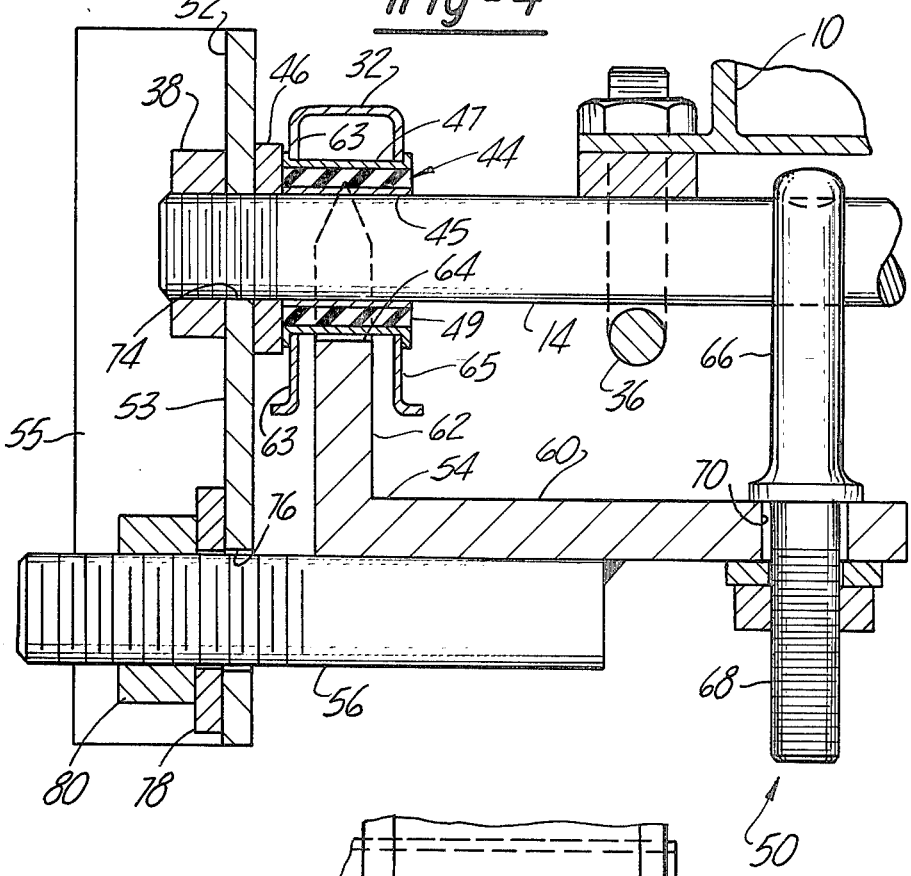
FIG. 4 is an enlarged fragmentary sectional view on line 4—4 in FIG. 2, but showing a tool of the present invention installed on the illustrated control arm.

FIG. 4 illustrates in a fragmentary fashion the right end area of shaft 14, with a tool of the present invention installed thereon. The shaft extends through a conventional bushing 44 carried by end section 32 of control arm 12. A similar bushing would be carried by the other end section 34 (FIG. 2) of the control arm. Bushing 44 comprises concentric sleeves 45 and 47, and an intervening rubber ring 49. A thrust washer 46 is slipped onto each end of shaft 14 to engage the associated bushing 44.

FIG. 4 shows the tool of the present invention installed on shaft 14. The tool comprises a heavy channel element 52 having an opening 74 in its web wall 53 for enabling the channel element to be installed on shaft 14. Nut 38 is threaded onto the shaft so that channel element 52 is rigidly clamped on the shaft (between nut 38 and thrust washer 46). When the vehicle is driven on the road, i.e. in service, the tool is removed and nut 38 is tightened to abut directly against washer 46.

Figure 8:
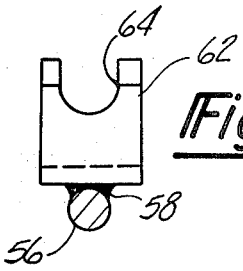
FIG. 8 is a fragmentary sectional view on line 8—8 in FIG. 7.
Figure 6:
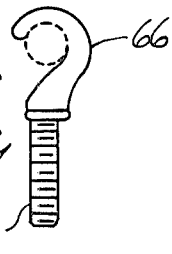
FIG. 6 illustrates a tension hook element used in the tool of FIG. 4.
Figure 7:
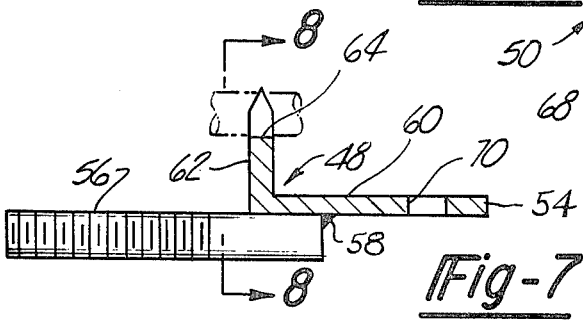
FIG. 7 is a sectional view through a die element forming part of the tool shown in FIG. 4.

FIGS. 6 through 8 illustrate some of the individual components used to form the complete tool depicted in FIG. 4; the aforementioned channel element 52 is utilized with the illustrated components to build up the completed tool. FIG. 6 illustrates a hook-like hanger component 50, while FIGS. 7 and 8 illustrate one of the presser elements 48. The aforementioned channel 52 forms a second cooperating presser element.

Presser element 48 includes an angle iron 54 and threaded stud 56 welded thereto, as at 58. Angle iron 54 includes a base wall 60 and an upstanding flange or wall 62, said flange having a semi-circular notch 64 in its upper edge for partial encirclement of bushing 44. The extreme upper edge areas of wall 62 are sharpened to a chisel character for easier penetration into a partially closed control arm (i.e. when flange 63 is bent).

Hanger component 50 includes an open-mouthed hook element 66 and a threaded stem 68, said stem being adapted to extend through a hole 70 in base wall 60 after hook element 66 has been inserted over shaft 14; FIG. 6 shows a shaft 14 in dashed lines. Component 50 is operatively connected to anchorage element 54 by manually threading nut 72 upwardly along stem 68, as best shown in FIG. 4

The channel-shaped presser element 52 is best shown in FIG. 4; it includes a web wall 53 and flanges 55. An opening 74 is formed in web wall 53 for receiving the threaded end of shaft 14. A second opening 76 is provided to receive the aforementioned stud 56. Channel element 52 is rigidly attached to shaft 14 by first removing nut 38, inserting the channel element on shaft 14, and then retightening nut 38 on the threaded end of the shaft. After channel element 52 is locked to shaft 14 (with stud 56 loosely projecting through opening 76) a washer 78 and nut 80 are applied to the stud as shown in FIG. 4. Thereafter a power wrench is applied to nut 80 to advance said nut rightwardly along stud 56. As nut 80 advances along the stud the washer 78 applies a rightward force on wall 53. Since wall 53 is rigidly attached to pivot shaft 14 the effect is to draw presser element 48 and hanger component 50 leftwardly, whereby wall 62 forcibly engages the outer flange 63 of the U-cross sectioned portion 32 of the control arm. By continued actuation of the power wrench it is possible to remove bend strains previously formed in flange 63 by rough road service.

Figure 5:
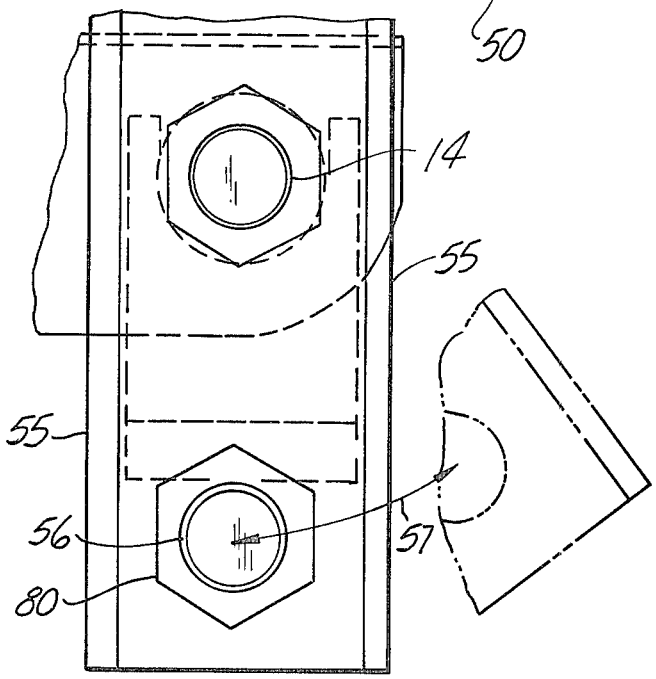
FIG. 5 is an end elevational view of the FIG. 4 assembly.

The construction of this tool is such that the tool can be adjusted around the axis of shaft 14, as shown by arrows 57 in FIG. 5. Before each such adjustment of the tool it is first necessary to loosen nut 38. The purpose for such an adjustment is to enable repositionment of the tool so that presser wall 62 can effectively engage a major part of the flange 63 area surrounding the bushing 44.

It will be understood that this tool is effective only to remove bends or deformations in the areas of flange 63 immediately adjacent to bushing 44. The tool cannot be used to remove bends in other areas of control arm 12. Applicant has found on the basis of his experience in servicing-repairing vehicles having stamped metal lower control arms that quite often major deformation of the control arm takes place in the area of flange 63 nearest bushing 44. The tool of this invention was specifically developed to remove such deformation.

I wish it to be understood that I do not desire to be limited to the exact details of construction shown and described for obvious modifications will occur to a person skilled in the art.

I claim:

1. In association with a vehicle suspension that includes a fixed pivot shaft extending through bushings carried within U-cross sectioned end portions of a stamped metal control arm: the improvement comprising a tool installable on the pivot shaft for straightening a bent flange on a U-cross sectioned portion of the control arm; said tool comprising a first presser element (48) having a shaft-engageable hanger component (50) connected thereto for operatively locating said first presser element against one surface of the bent flange, a threaded stud (56) non-rotatably secured to said first presser element for disposition generally parallel to the control arm pivot shaft when the presser element is in its operative location, a second presser element (52) having a first opening therethrough for its mounting on an end of the pivot shaft, said second presser element having a second opening therethrough for loosely encircling an end of the aforementioned threaded stud, a first nut (38) threadable onto the pivot shaft, said nut being rotatable on said pivot shaft to thereby rigidly secure the second presser element to said shaft; and a second nut threadable onto the end of the stud that projects through the second opening, whereby the first presser element is forcibly drawn toward the second presser element to exert a straightening force on the bent flange, said first presser element comprising an angle member (54) having a first wall adapted to extend parallel to the pivot shaft, and a second upstanding wall adapted to extend into the U-shaped cross section of the metal control arm; said upstanding wall having a semicircular notch in its upper edge for partial encirclement of the bushing carried within the control arm; the extreme upper edge of the upstanding wall being sharpened to a chisel character, whereby the first presser element can be forced into operative engagement with the bent flange on the control arm even though the U-cross sectioned end portion of the control arm is partially closed.

2. The tool of claim 1 wherein said first presser element (48) has a detachable connection with the hanger component, whereby the hanger component and first presser element can be connected together after the hanger component has been hooked over the pivot shaft; said detachable connection comprising a threaded stem extension (68) on the hanger component adapted to extend through a hole in the first presser element, and a nut screwable onto the stem extension clamp the hanger component to the presser element.

3. The tool of claim 1 wherein the hanger component (5) includes an open-mouthed hook element having a circular interior surface conforming to the control arm pivot shaft, whereby the tool can be adjusted around the shaft axis.

* * * * *